US010428668B2

(12) United States Patent
Schlemmer et al.

(10) Patent No.: US 10,428,668 B2
(45) Date of Patent: Oct. 1, 2019

(54) VANE SEGMENT WITH PERIPHERAL SECURING

(71) Applicant: MTU Aero Engines AG, Munich (DE)

(72) Inventors: Markus Schlemmer, Sandelzhausen (DE); Oliver Thiele, Dachau (DE); Bernd Kislinger, Reisgang (DE); Wilfried Schuette, Oberhaching-Furth (DE); Manuel Hein, Karlsfeld (DE)

(73) Assignee: MTU Aero Engines AG, Munich (DE)

( * ) Notice: Subject to any disclaimer, the term of this patent is extended or adjusted under 35 U.S.C. 154(b) by 418 days.

(21) Appl. No.: 15/350,147

(22) Filed: Nov. 14, 2016

(65) Prior Publication Data

US 2017/0145842 A1 May 25, 2017

(30) Foreign Application Priority Data

Nov. 19, 2015 (DE) ..... 10 2015 222 834

(51) Int. Cl.
*F01D 9/04* (2006.01)
*F01D 25/24* (2006.01)
*F01D 5/18* (2006.01)

(52) U.S. Cl.
CPC ..... *F01D 9/042* (2013.01); *F01D 9/041* (2013.01); *F01D 25/246* (2013.01); *F01D 5/18* (2013.01); *F05D 2220/323* (2013.01); *F05D 2230/21* (2013.01); *F05D 2240/24* (2013.01); *F05D 2260/30* (2013.01)

(58) Field of Classification Search
CPC ..... F01D 9/041; F01D 9/042; F01D 25/246
See application file for complete search history.

(56) References Cited

U.S. PATENT DOCUMENTS 3,403,889 A * 10/1968 Ciokajlo ..... F01D 25/162 415/118
8,360,716 B2 1/2013 Bergman et al.
8,425,184 B2 * 4/2013 Druez ..... F01D 9/042 415/173.1
2001/0018020 A1 * 8/2001 Tiemann ..... F01D 9/042 415/115

(Continued)

FOREIGN PATENT DOCUMENTS

DE 10331599 A1 2/2005
EP 2615243 A1 * 7/2013 ..... F01D 5/147

(Continued)

*Primary Examiner* — Woody A Lee, Jr.
(74) *Attorney, Agent, or Firm* — Barlow, Josephs & Holmes, Ltd.

(57) ABSTRACT

The invention relates to a guide vane segment for an aircraft gas turbine, comprising at least a radially outer shroud and a radially inner shroud, which extend along a respective circular arc and together form a ring segment, wherein, in the radial direction, between the outer shroud and the inner shroud, a plurality of guide vanes are arranged next to one another in the peripheral direction (UR), the vanes being materially joined with the inner shroud and the outer shroud, in particular joined in one piece. At least two securing ribs are arranged next to one another are formed on the trailing end face for at least one guide vane, wherein an intermediate space delimited by the two securing ribs in the peripheral direction (UR) is formed, this space tapering from radially outside to radially inside.

12 Claims, 2 Drawing Sheets

(56) References Cited

U.S. PATENT DOCUMENTS

| | | | | |
|---|---|---|---|---|
| 2007/0183898 | A1 | 8/2007 | Hurst et al. | |
| 2013/0189108 | A1* | 7/2013 | Schlemmer | F01D 5/147 416/212 A |
| 2014/0301840 | A1 | 10/2014 | Hein et al. | |
| 2015/0030443 | A1 | 1/2015 | Richardson et al. | |

FOREIGN PATENT DOCUMENTS

| | | | |
|---|---|---|---|
| EP | 2615243 | A1 | 7/2013 |
| FR | 2928962 | A1 | 9/2009 |
| WO | 2013171407 | A1 | 11/2013 |

* cited by examiner

VANE SEGMENT WITH PERIPHERAL SECURING

BACKGROUND OF THE INVENTION

The invention relates to a guide vane segment for a gas turbine, in particular an aircraft gas turbine, comprising at least a radially outer shroud and a radially inner shroud, which extend along a respective circular arc and together form a ring segment, wherein, in the radial direction, a plurality of guide vanes are disposed next to one another between the outer shroud and the inner shroud in the peripheral direction, the guide vanes being materially joined with the inner shroud and the outer shroud, in particular joined in one piece; wherein, referred to an axial longitudinal direction, the outer shroud comprises an axially forward or leading end face element and an axially rear or trailing end face element, so that the outer shroud and the two end faces form a tub-like profile in longitudinal section, wherein a reinforcement rib assigned to each guide vane is formed on the outer shroud and extends between the two end faces.

Directional indications such as "axial" or "axially", "radial" or "radially", and "peripheral" are basically to be understood as referred to the machine axis of the gas turbine, as long as something different does not ensue explicitly or implicitly from the context.

In order to secure guide vane segments of this type in a housing belonging to them in the peripheral direction, it is known to employ pin-type elements (so-called pin locking) or to solder a securing element designed therefor on the guide vane segment, whereby the use of additional components such as securing elements requires additional working steps during assembly.

SUMMARY OF THE INVENTION

The object of the invention is to improve a guide vane segment with respect to its installation and securing in a housing belonging thereto, so that the above disadvantages can be overcome.

In order to achieve this, it is proposed that at least two securing ribs arranged next to one another are formed on the trailing end face for at least one guide vane, whereby an intermediate space delimited by the two securing ribs in the peripheral direction is formed, which tapers from radially outside to radially inside.

Pin locking or soldered securing elements can be dispensed with due to the proposed configuration of the guide vane element having the two securing ribs and the intermediate space formed between them. This simplifies the assembly or the manufacture of the gas turbine.

It is preferred that the two securing ribs are formed by a first securing rib and a second securing rib, the first securing rib being joined to the reinforcing rib of the assigned guide vane lying inside in the peripheral direction.

It is further proposed that the second securing rib is formed only in the trailing end face.

The configuration of the two securing ribs represents an optimized adaptation to the structural rigidity on the respective guide vane in combination with the desired peripheral securing by the two securing ribs.

As an enhancement, it is proposed that the first securing rib and the second securing rib have rib widths that are different from one another, referred to a width direction running along a peripheral direction tangent, whereby, in each case, the peripheral direction tangent lies at the same radial distance from the center of the circular segment.

It is preferred, in this case, that the first securing rib or/and the second securing rib has/have a width increasing from radially outside to radially inside.

It is further proposed that the first and the second securing ribs at the same radial distance from the center of the circular segment have rib heights that are different from one another, measured in the axial direction.

In this case, the first securing rib can have a greater rib height and a greater rib width than the second securing rib at the same radial distance from the center of the circular segment.

Two securing ribs, which are optimally adapted in their dimensions and their respective form for the peripheral securing of the guide vane segment result from these individually preferred features. The shaping can be extensively optimized, in particular, also by being able to achieve an improved pressing of the surfaces between the securing ribs and an applied housing component, in particular a housing groove that accommodates one of the two securing ribs. An optimal peripheral securing can be made possible for the guide vane segments used in a gas turbine, particularly an aircraft gas turbine, for any operating state of the gas turbine.

The guide vane segment preferably comprises at least three guide vanes, and more preferably, four to six guide vanes, wherein the two securing ribs, referred to the peripheral direction, are assigned to an inner-lying guide vane (16, 16*a*), preferably of the second or the third or the fourth guide vane. Of course, the guide vane segment can also have another number of guide vanes, in particular, 7 or more. In general it can also be stated that the two securing ribs, referred to the peripheral direction, are arranged in a central region of the trailing end face or are assigned to a guide vane that lies adjacent to the center of the end face, or, in the case of an uneven number of guide vanes, are assigned to the central guide vane.

In order to improve the structural rigidity, it is preferred that the two securing ribs are formed in one piece with the trailing end face, particularly in one piece with the guide vane segment.

The invention also relates to a gas turbine, in particular an aircraft gas turbine having at least one annular guide vane module that is composed of a plurality of the above-described guide vane segments.

In this case, the guide vane can be part of a turbine stage, in particular a turbine stage of a low-pressure turbine.

In the case of the gas turbine, it is further preferred that a housing element of the turbine, especially of the low-pressure turbine is configured such that it is joined to the securing ribs of at least one guide vane segment in form-fitting or/and friction-fitting manner in such a way that during operation of the gas turbine, the guide vane segment is held, at least in the peripheral direction, by the connection between housing and securing ribs. In this case, it is preferred that the connection between housing and securing ribs is formed by a groove that takes up the securing ribs.

BRIEF DESCRIPTION OF THE DRAWING FIGURES

The invention will be described below with reference to the attached figures by way of example and not in any limiting manner.

DESCRIPTION OF THE INVENTION

Figure 1:
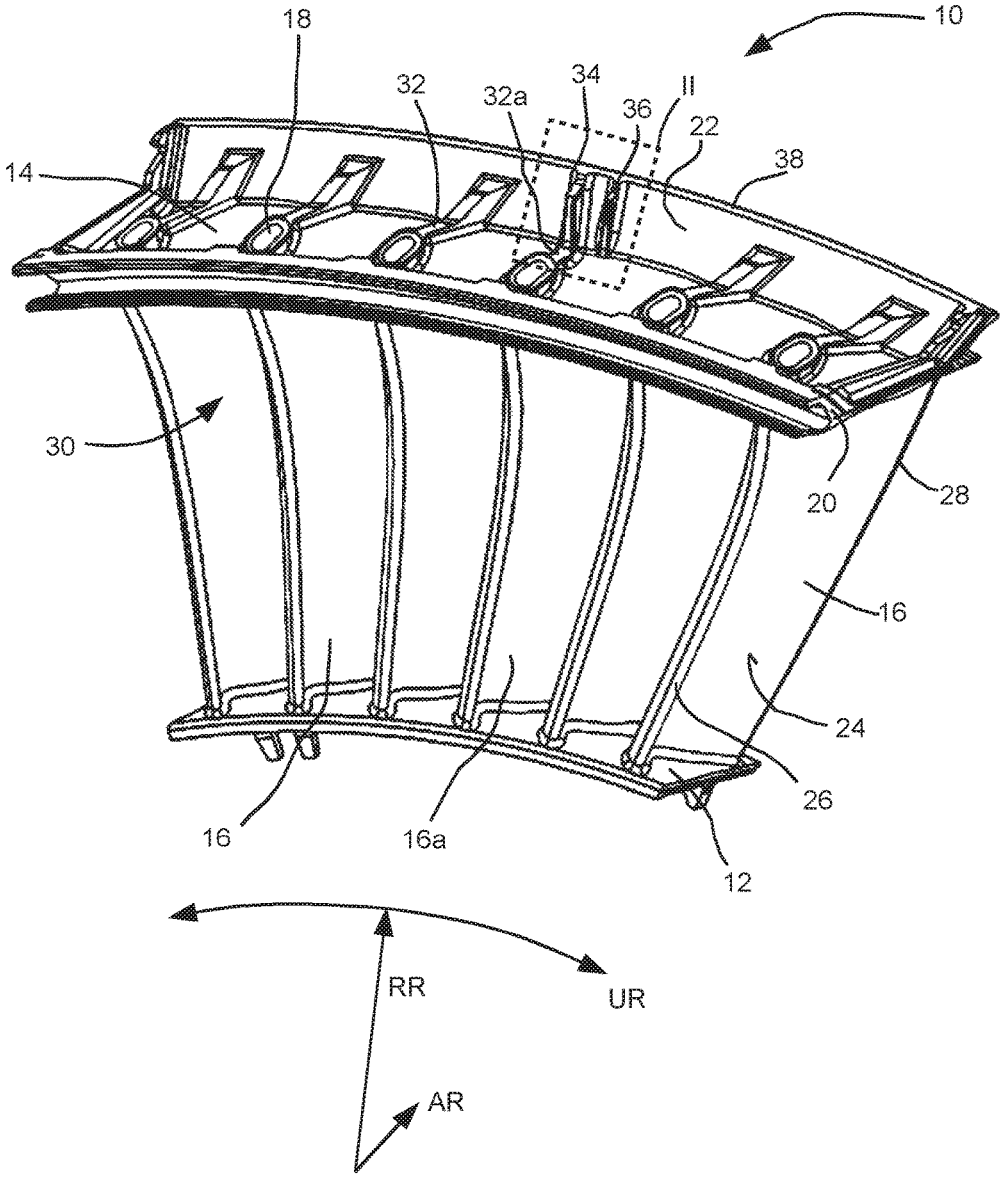
FIG. 1 shows, in a simplified schematic perspective illustration, an embodiment of a guide vane segment.

A guide vane element 10 shown simplified and perspectively in FIG. 1 comprises a radially inner shroud 12 (bottom in in FIG. 1), a radially outer shroud 14 (top in FIG. 1), and a plurality of guide vanes 16, which are arranged between the two shrouds 12 and 14 in the radial direction RR. In the peripheral direction, a plurality of guide vanes 16 are arranged next to one another. The two shrouds 12, 14 form a ring segment, wherein a plurality of guide vane segments that are combined into a guide vane ring (not shown) delimit an annular channel in the radial direction RR and in the peripheral direction UR, and a fluid, in particular a hot gas, can flow through this channel in the axial direction AR.

The guide vanes 16 are joined, preferably materially, with the two shrouds 12 and 14, and are particularly formed in one piece. A guide vane segment 10 can be manufactured from metal, particularly by casting methods. The guide vanes 16 are preferably formed as hollow. Openings 18, which are connected to the hollow space of the individual guide vanes 16, are visible on the radially outer shroud 14, and these openings especially serve for the purpose of removing the casting core after the guide vane segment 10 is cast from the individual guide vanes 16.

In the case of the radially outer shroud 14, in the axial direction AR, a leading end face 20 and a trailing end face 22 are provided, which project from the shroud 16 radially outward, in such a way that the shroud 14 and the end faces 20, 22 have a tub-shaped profile in a longitudinal section parallel to the axial direction AR. The end faces 20, 22 are inclined relative to the radial direction, preferably at an angle of approximately 20° to 45°.

As can be seen from FIG. 1, the guide vanes 16 have a flow profile or vane profile with a convex suction side, which is not visible due to the viewing angle, and a concave pressure side 24, the suction side and the pressure side 24 being joined together via a leading edge 26 and a trailing edge 28. If hot gas flows in the essentially axial direction AR into the flow channels 30 formed by the shrouds 12, 14 and the guide vanes 16, due to the flow profiles of guide vanes 16, a force acting toward the left in the peripheral direction UR (or in the counter-clockwise direction) in the embodiment shown, acts on the guide vane segment 10. In order to ensure the necessary structural strength, a reinforcement rib 32 can be assigned to each guide vane 16 in the radially outer shroud 14, in order to support the forces acting on the shroud 14 or on the end faces 20, 22.

The forces operating when hot gas flows through in the peripheral direction UR are further supported by at least two securing ribs 34, 36 on a housing (not shown) that takes up the guide vane segment 10, so that the guide vane segment 10 or a guide vane ring formed from a plurality of guide vane segments of a turbine stage of a gas turbine is secured in the peripheral direction.

Figure 2:
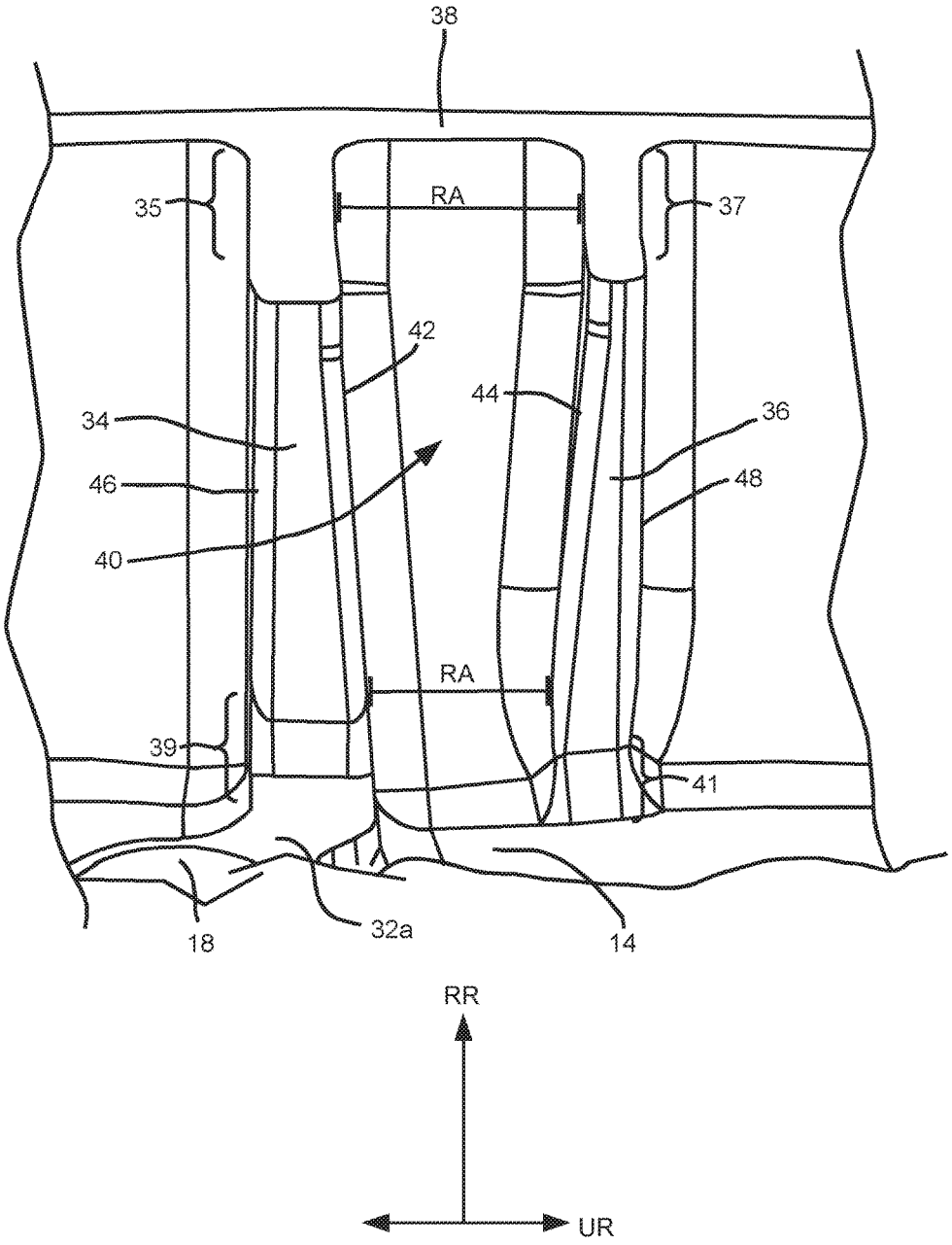
FIG. 2 shows securing ribs, in a schematic, enlarged perspective illustration, according to the region II shown by the dotted line of FIG. 1.

The configuration and arrangement of a first securing rib 34 and a second securing rib 36 is explained below with reference to the enlarged illustration of FIG. 2, which corresponds to region II of FIG. 1 outlined by the dashed line.

The first securing rib 34 extends in the radial direction RR from an upper edge 38 of the end face 22 toward the bottom or radially inside. In its upper region, proceeding from the upper edge 38, it has a transition region 35, which is preferably formed inclined or stepped. In its lower region, at reference 39 (transition region), it transitions directly into the reinforcement rib **32*a* assigned to the guide vane 16*a* (FIG. 1). The first securing rib 34 has a width running along a peripheral direction tangent in the peripheral direction UR, whereby the width increases from radially outside to radially inside. In the axial direction, the first securing rib 34 stands out from the end face 22** and has a height belonging thereto running in the axial direction.

The second securing rib 36 also extends in the radial direction RR from the upper edge 38 of the end face 22 toward the bottom or radially inward. In its upper region, proceeding from the upper edge 38, it has a transition region 37, which is preferably formed inclined or stepped. Of course, the second securing rib in the radial direction RR terminates in a final region 41 between end face 22 and shroud 14, which is only indicated in this illustration. The second securing rib 36 is thus preferably provided only on the end face 22 and does not have a rib-like extension or connection to another reinforcement rib of a guide vane. Also, the second securing rib 36 has a width running in the peripheral direction UR or along a peripheral direction tangent, whereby the width increases from radially outside to radially inside. In the axial direction, the second securing rib 36 stands out from the end face 22 and has a height belonging thereto running in the axial direction.

The first securing rib 34 and the second securing rib 36 are arranged at a distance RA from one another, which corresponds to a width of an intermediate space 40 formed between the two securing ribs 34, 36. The width RA of the intermediate space 40 decreases from radially outside to radially inside. The intermediate space 40 is thus formed as tapering or narrowing from radially outside to radially inside. This tapering of the intermediate space 40 is thereby formed such that a first inner wall 42 of the first securing rib 34 that faces the intermediate space 40 and a second inner wall 44 of the second securing rib 36 that faces the intermediate space 40 run at an incline to one another. In this case, both inner walls 42, 44 are inclined at least referred to a plane spanned by the radial direction RR and the axial direction, this plane running essentially orthogonal to the plane of the drawing in the present illustration.

Each securing rib 34, 36 has an outer wall 46 or 48 away from the intermediate space 40, wherein the outer wall 46 is assigned to the first securing rib 34, and the outer wall 48 is assigned to the second securing rib. In an assembled state of a gas turbine, the two securing ribs 34, 36 are accommodated in a common groove formed on a housing in such a way that the two outer walls 46, 48 can come into contact or stand in contact with corresponding inner sides of the housing groove, which is not shown. This flat surface positioning of the outer walls 46, 48 on the inner sides of the housing groove makes possible a support of the guide vane segment on the housing in the peripheral direction. The outer walls 46, 48 of the first securing rib 34 and of the second securing rib 36 preferably extend essentially parallel or slightly convergent to one another from radially inside to radially outside. If the outer walls 46, 48 are formed in this way, the guide vane element 10, in the radial direction, can be inserted smoothly and easily into the groove of the housing that accommodates the securing ribs 34, 36. The groove of the housing can be manufactured in an especially simple manner, if the walls bounding the groove in the peripheral direction also run essentially parallel or slightly convergent to one another from radially inside to radially outside.

Between the radially outer transition region 35 and the radially inner transition region 39, over the total radial length, the width of the first securing rib 34 is greater than the width of the second securing rib 36 between the radially outer transition region 37 thereof and its terminal region 41. Additionally, the height, i.e., the dimension in the axial direction, of the first securing rib 34 between the transition region 35 and the transition region 39 is greater than the height of the second securing rib 36 between the transition region 37 thereof and its terminal region 41. In other words, with the same radial distance from the center, the cross-sectional surface area of the first securing rib 34 is greater than the cross-sectional surface area of the second securing rib 36. This applies to the embodiment shown here for the entire radial length of the first and the second securing ribs 34, 36. Correspondingly, the outer surface 46 of the first securing rib 34 is greater than the outer surface 48 of the second securing rib 36.

The dimensioning of the two securing ribs is made taking into consideration the arrangement of guide vanes 16 and the vane profile thereof as well as the force effects associated therewith on the guide vane segment 10 in the peripheral direction. As has already been described above, in the present embodiment, when hot gas flows through the guide vane segment 10 or through a closed guide vane ring, greater pressure forces act in the peripheral direction toward the left (counterclockwise), so that during operation, greater forces must be supported in the peripheral direction by the first securing rib 34. In particular, the larger outer surface 46 of the first securing rib 34 makes possible a sufficient surface pressing and supporting of the guide vane segment 10 in the housing or in the groove provided in the housing.

The width RA of the intermediate space 40, which decreases from radially outside to radially inside, is brought about the increasing width of the first and the second securing ribs 34, 36. The two securing ribs 34, 36 thus have their greatest width radially inside, referred to the radial length of the two securing ribs 34, 36 below (radially inward) their respective center. In particular, in the transition region between the reinforcing rib 32*a* of the guide vane 16*a*, acting forces that are greater than those that still operate radially outside can be optimally supported in this way, via the shroud 14, the end face 22 and the securing ribs 34, 36.

The embodiment shown here is merely an example. The first and the second securing ribs 34, 36 could also be reversed, for example, if the guide vanes 16 were to be configured differently with respect to their vane profile; in particular, the pressure side and the suction side could be reversed, so that greater pressure forces would operate toward the right (clockwise) in the peripheral direction. The dimensioning of the two securing ribs can be adapted to different gas turbines or to different housings. In this case, different forms and dimensions of the two securing ribs 34, 36, are already considered in the manufacture of a guide vane segment 10, so that a finished guide vane element 10, in particular produced by casting, already has the two securing ribs 34, 36, which are designed in one piece with the guide vane segment. Overall, an optimized adjustment of the pressing of surfaces between the securing ribs and the housing groove can be achieved by the selection and dimensioning of the two securing ribs. Further, cost savings result in the manufacture of the housing by the selection of an optimized distance between the two securing ribs, by the omission of additional processing steps, such as, e.g., application of soldering material or insertion of locking pins, and the like. The two securing ribs 34, 36 thus make possible overall a flexible adaptation to necessary special structural features of a gas turbine type in which guide vane segments will be employed.

What is claimed is:

1. A guide vane segment for an aircraft gas turbine, comprising at least a radially outer shroud and a radially inner shroud, which extend along a respective circular arc and together form a ring segment, wherein, in the radial direction, between the outer shroud and the inner shroud, a plurality of guide vanes are arranged in the peripheral direction next to one another, the vanes being materially joined with the inner shroud and the outer shroud, joined in one piece, wherein the outer shroud, in an axial longitudinal direction, comprises an axially forward or leading end face element and an axially rear or trailing end face element, such that the outer shroud and the two end faces form a tub-shaped profile in longitudinal section, wherein a reinforcement rib assigned to each guide vane is formed on the outer shroud and extends between the two end faces, wherein at least two securing ribs arranged next to one another are formed on the trailing end face for at least one guide vane, wherein a gap is delimited by the two securing ribs in the circumferential direction, and wherein a width of the gap decreases radially from the outside to the inside such that the gap tapers radially from the outside to the inside.

2. The guide vane segment according to claim 1, wherein the two securing ribs are formed by a first securing rib and a second securing rib, wherein the first securing rib is joined with the reinforcement rib of the inner-lying, assigned guide vane in the peripheral direction.

3. The guide vane segment according to claim 2, wherein the second securing rib only is formed in the trailing end face.

4. The guide vane segment according to claim 2, wherein the first securing rib and the second securing rib have rib widths that differ from one another, referred to a width direction running along a peripheral direction tangent, wherein the peripheral direction tangent lies at the same radial distance from the center of the circular segment in each case.

5. The guide vane segment according to claim 4, wherein the first securing rib or/and the second securing rib have a width increasing from radially outside to radially inside.

6. The guide vane segment according to claim 2, wherein the first and the second securing ribs have rib heights that differ from one another, measured in the axial direction, at the same radial distance from the center of the circular segment.

7. The guide vane segment according to claim 6, wherein the first securing rib has a greater rib height and a greater rib width than the second securing rib at the same radial distance from the center of the circular segment.

8. The guide vane segment according to claim 1, further comprising at least three guide vanes, wherein the two securing ribs, referred to the peripheral direction, are assigned to an inner-lying guide vane, to a second or a third or a fourth guide vane.

9. The guide vane segment according to claim 1, wherein the two securing ribs are configured in one piece with the trailing end face with the guide vane segment.

10. An aircraft gas turbine including a plurality of guide vane segments according to claim 1.

11. The aircraft gas turbine according to claim 10, wherein the plurality of guide vane segments are part of a turbine stage of a low-pressure turbine.

12. The aircraft gas turbine according to claim 11, wherein a housing element of the low-pressure turbine is configured such that it is joined to the securing ribs of at least one guide vane segment in form-fitting or/and friction-fitting manner so that during operation of the gas turbine, the guide vane segment is held, at least in the peripheral direction, by the connection between housing and securing ribs, wherein the connection between housing and securing ribs is formed by a groove that accommodates the securing ribs.

* * * * *